United States Patent [19]

Mojden

[11] Patent Number: 4,742,669

[45] Date of Patent: May 10, 1988

[54] CAN END COUNTING SYSTEM

[75] Inventor: Andrew E. Mojden, Hinsdale, Ill.

[73] Assignee: Fleetwood Systems, Inc., Countryside, Ill.

[21] Appl. No.: 913,019

[22] Filed: Sep. 29, 1986

[51] Int. Cl.[4] ..... B65B 57/20

[52] U.S. Cl. ..... 53/500; 53/532; 53/542

[58] Field of Search ..... 53/542, 532, 500, 254; 414/46

[56] References Cited

U.S. PATENT DOCUMENTS

| | | | |
|---|---|---|---|
| 3,313,482 | 4/1967 | Midgely et al. | 235/98 |
| 3,732,665 | 5/1973 | Pitts | 53/542 X |
| 3,971,189 | 7/1976 | Mojden et al. | 53/63 |
| 4,417,435 | 11/1983 | Wakamatsu et al. | 53/532 |
| 4,537,550 | 8/1985 | Mojden et al. | 414/46 |

*Primary Examiner*—James F. Coan

*Attorney, Agent, or Firm*—Trexler, Bushnell, Giangiorgi & Blackstone, Ltd.

[57] ABSTRACT

A can end counting system comprises an elongate trough-like member for receiving and guiding a plurality of can ends in a substantially upright, nested condition. The trough-like member defines a longitudinal axis and has an entrance end and an exit end relative to the direction of travel of can ends therethrough. A pusher is provided adjacent the entrance end of the trough-like member for pushing the can ends therealong. A resisting apparatus is located along the trough-like member for engaging the can ends in a fashion for maintaining a controlled degree of resistance of the can ends relative to the pusher so as to maintain the can ends in the desired upright and nested condition as they travel through the trough-like member. A counting apparatus is located adjacent the exit end of the trough-like member for producing a discrete detectable signal in response to the passage of each can end thereby, such that the discrete signals may be detected and counted to maintain a count of the can ends passing through the counting system.

7 Claims, 3 Drawing Sheets

CAN END COUNTING SYSTEM

BACKGROUND OF THE INVENTION

This invention relates generally to devices for handling and counting discrete articles, and more particularly to a novel and improved can end handling apparatus capable of receiving a continuous flow of can ends either in a nested or stacked condition or individually, and delivering a stack of nested and accurately counted can ends to a packaging or bagging station.

In the manufacture of cans, the bodies and ends of the cans are generally separately fabricated and packaged for later assembly in connection with the filling process. Generally speaking, the producer of the canned product purchases the necessary number of can bodies and can ends for subsequent assembly. The bodies may have one end preformed in the material of the body or one end pre-attached when a cylindrical, open-ended type of body is used. It is therefore necessary that the number of separate can ends delivered to the producer be substantially equal to the number of can bodies delivered, so that production runs are not interrupted due to an insufficient supply of ends.

As mentioned, the can ends are shipped pre-packaged, preferably in a stacked or nested condition in elongated kraft paper bags. Preferably, each bag should contain substantially the same, preselected number of ends. Often the can ends are shipped in lots or bags of 300 or more. It is preferable that, regardless of the size of the bag, a relatively accurate count of can ends be maintained within a relatively small margin over a relatively large number of bags forming a given shipment or order. Since the number of can ends in a given order or shipment may run into the millions, it will be appreciated that manual counting of the can ends in each bag is impractical.

While a number of mechanized or automated counting methods were employed and attempted in years past, none has proven particularly reliable or workable, until relatively recently. More recently, we developed a novel and reliable apparatus for counting and packaging can ends, as shown and described in our U.S. Pat. No. 3,971,189, issued July 27, 1976. While this apparatus has found widespread commercial acceptance, there is room for further improvement. In particular, the increasing use of cans having ends with preformed tab-like closures, often popularly called "pop-top" cans has given rise to some additional problems. These tab-like closures may be completely removable, or may be designed to be retained on the can end following opening thereof. In either instance, the provision of can ends with such tabs preformed thereon has created some novel problems in the handling, counting and packaging or bagging of can ends.

More specifically, it is generally desirable that the can ends be handled and packaged in a stacked or nested condition. In this regard, the peripheral edge of each can is generally formed in a reversely bent edge known as the "curl". It is desired that the ends nest in an abutting curl-to-curl relationship to form a relatively compact stack of ends. This relatively closely stacked or nested condition of the can ends generally permits preformed stacks or "sticks" as they are often called in the art, to be relatively easily fed through conveyor systems utilizing generally tubular or arcuate trough-like guides or the like.

However, it will be appreciated that the additional provision of a slightly protruding tab member on one surface of the can end tends to make the desired nesting or stacking more difficult to achieve and maintain. This occurs because the tabs often become spaced outwardly somewhat from the surface of the can and take a slight set such that a slight spring-like action is experienced when the cans are pressed together into the desired nested or stacked condition. Moreover, the outermost extent of the tab relative to the can end surface is usually off center somewhat, such that the spring-like action tends to cause relative tilting or canting of one can end relative to the next adjacent can end in a stack or stick. Accordingly, should the can ends in a stack become sufficiently separated during handling, or should one or more leading or trailing ends in a stick begin to tilt or cant due to the above-described action of the preformed tabs, clogging or jamming of the handling equipment may result. Such clogging or jamming requires a shutdown of relatively high speed production and handling equipment to correct the problem, and this is relatively expensive, time consuming and hence undesirable.

Advantageously, our present invention provides for the handling and counting of can ends while maintaining the same in the desired closely stacked or nested condition throughout the handling and counting procedure. Hence, the invention not only prevents relatively costly clogging and jamming of the machinery due to tilted or dislodged can ends, but also maintains a relatively accurate count of ends fed to a bagging or packaging station.

BRIEF DESCRIPTION OF THE DRAWINGS

The features of the present invention which are believed to be novel are set forth with particularity in the appended claims. The organization and manner of operation of the invention together with further objects and advantages thereof, may best be understood by reference to the following description taken in connection with the accompanying drawings in the several figures of which like references numerals identify like elements, and in which:

DETAILED DESCRIPTION OF THE ILLUSTRATED EMBODIMENT

Figure 1:
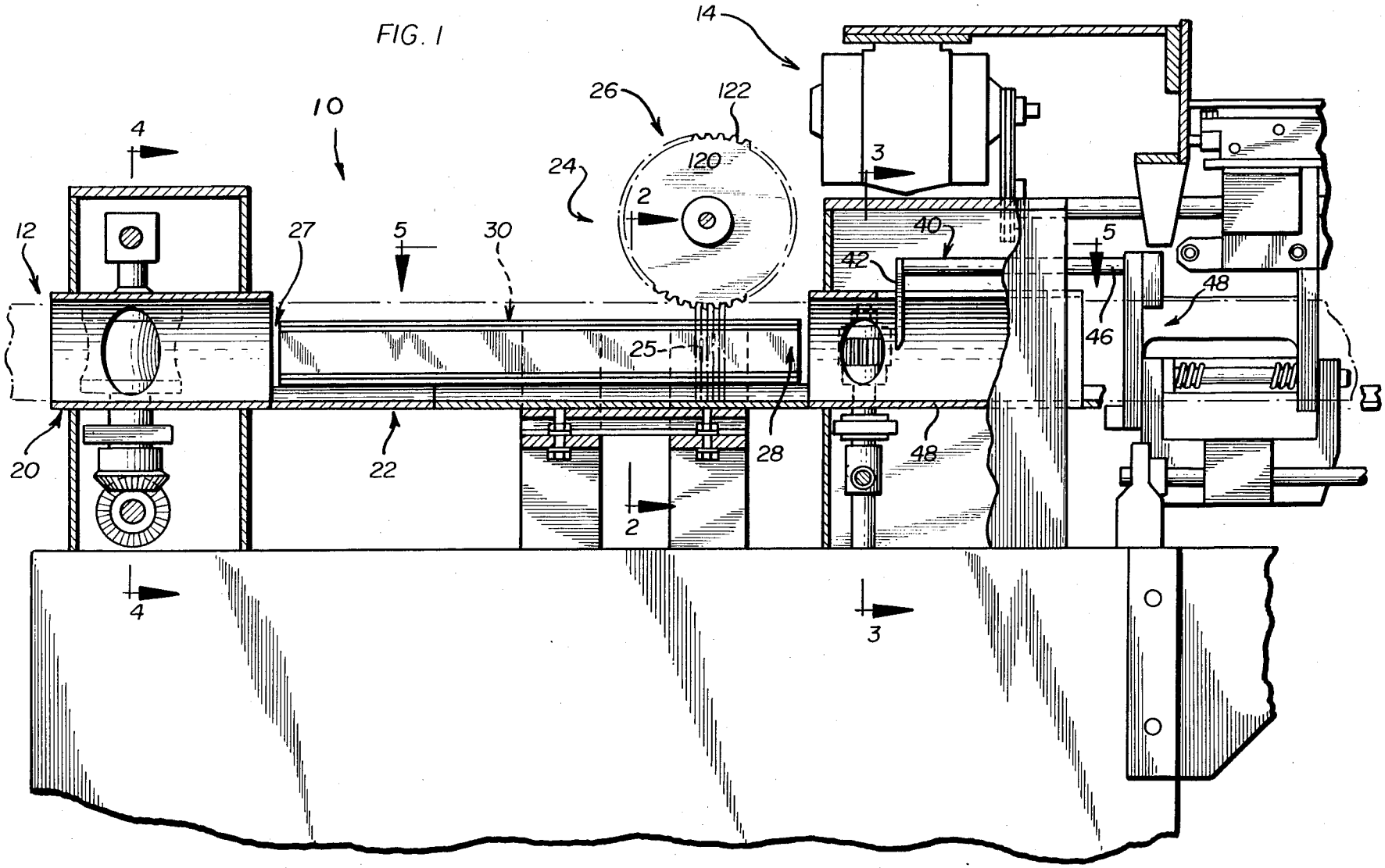
FIG. 1 is a side elevation, partially in section and partially broken away, illustrating a portion of a can end handling apparatus employing a novel handling and counting system in accordance with the invention.

Referring now to the drawings, initially to FIG. 1, a can end handling and counting system incorporating features of the invention is designated generally by the reference numeral 10. In many respects, the system 10 is similar to the apparatus illustrated and described in our prior U.S. Pat. No. 3,971,189, issued July 27, 1976, to Moyden, et al., upon which the present invention improves in several respects. Hence, reference is invited to this earlier patent for a discussion of some of the details of the apparatus 10 which do not form a part of the present invention. In operation, it is intended that a more or less continuous stream or flow of can ends is fed to an inlet side 12 of the apparatus 10, wherein the can ends are maintained in a stacked or nested condition and accurately counted by counting apparatus in accordance with the present invention. Thereafter, the counted can ends are fed to an initially or inlet portion of a further apparatus 14 for separating the nested or stacked ends into groups of the desired number for packaging or bagging. In this regard, the can ends are shown in the drawings in phantom line, designated generally by reference numeral 25.

As previously noted, it is desired to keep the can ends in a substantially upright stacked or nested condition as they pass through the handling and counting portion of the apparatus, prior to the separating apparatus 14. However, many can ends are provided with a preformed removable tab or "pop-top" member, maintaining such ends in the desired closely stacked and nested condition often proves difficult in practice. This occurs because the tab member tends to exhibit a spring-like action relative to the surface of the can end, which action tends to cause a relative tilting or canting of one can end relative to the next adjacent can end.

At the inlet end 12 of the apparatus, there is provided a novel pushing or can end-advancing and repositioning means or apparatus designated generally by reference numeral 20. This apparatus 20 is disposed at the forward or entering end of an elongate trough-like member or guide means 22. The can ends are accepted by this advancing and repositioning means 20 and fed into an inlet end 27 of the trough 22 in a stacked or nested condition. In this regard, the can ends may be delivered to the inlet end 12 already in the stacked or nested condition, but in practice, the can ends are normally delivered to inlet 12 following application of a liner compound to the inner rim thereof. Accordingly, the ends will often arrive at inlet end 12 in a spaced, edgewise relationship. The details of the advancing and repositioning means or pushing means 20 will be discussed more fully hereinafter.

Disposed along the trough or guide means 22 is a monitoring or counting station 24. This station 24 may include means for visually observing or otherwise monitoring or sensing the stream or flow of can ends therethrough. In accordance with the present invention, however, the station 24 includes a counting means or apparatus, designated generally by reference numeral 26 which is generally located near or adjacent to an exit end 28 of the trough 22. This counting means or apparatus 26, as will be more fully described later herein, is adapted to produce a discrete detectable signal in response to the passage of each can end thereby. Accordingly, this discrete signal may be detected and counted by suitable related apparatus (not shown) in order to maintain an accurate count of the can ends passing through the counting system 10 and into the separating or grouping apparatus 14 for packaging or bagging of the desired numbers of ends in discrete packages.

In order to maintain the can ends in the desired upright and closely stacked or nested condition throughout the trough-like member 22, the invention provides novel resisting means, designated generally by reference numeral 30 (and best viewed in FIG. 2) for engaging the can ends in a predetermined fashion so as to maintain a controlled degree of resistance of the can ends relative to the pushing or advancing means 20. This controlled degree of resistance is such as to maintain the can ends in the desired upright and nested condition as they travel through the trough or trough-like member from entrance end 27 to exit end 28 thereof. Further details of these resisting means will be described later herein.

In the separating portion 14 of the packaging or bagging apparatus, a separator means or assembly 40 is activated after a predetermined number of can ends have been counted by the counter 26. This separator means may comprise an elongate, blade-like member 42 which may be inserted between the counted stacked or group of ends and the next adjacent end of the continuous stream of can ends flowing thereby so as to separate the flow of can ends into discrete counted stacks for packaging or bagging. Further preferred details of the separator means 40 and associated apparatus are shown in the above-referenced Moyden, et al. patent, to which reference is invited.

Figure 3:
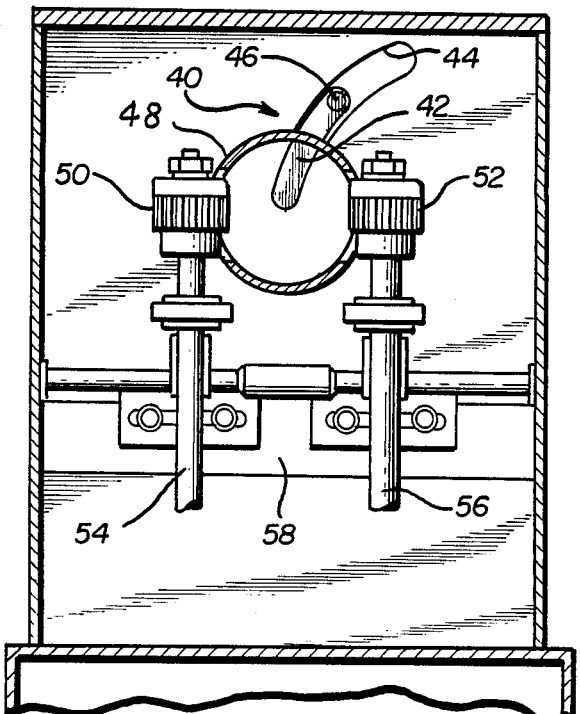
FIG. 3 is a partial sectional view taken generally in the plane of the line 3—3 of FIG. 1.

Briefly, and referring to FIG. 3, the separating means or apparatus includes the aforementioned blade-like member 42 which is mounted for bi-directional motion generally along a complementary slot 44 by means of a drive or actuating shaft or member 46, coupled to suitable drive means designated generally in FIG. 1 by reference numeral 48. The separator blade 42 is arranged to intersect a receiving slot or opening formed in a generally tubular or cylindrical guide or conduit 48 through which the can ends pass upon entering the apparatus 14. The can ends are preferably drive through this conduit 48 by means of a pair of spaced apart toothed roller means 50, 52 which are also arranged to intersect the tube 48 to contact the edges of the can ends to advance the same therethrough. These toothed wheel or roller members 50, 52 have longitudinal grooves formed along their faces for this purpose, that is, the width of each groove is preferably sized to receive a single can end at its edge, at a time. The rollers are rotatably secured on respective shaft members 54, 56 which are in turn rotatably journalled to a transverse support member or beam 58. The shaft members 54, 56 are then rotated by suitable drive means 48, indicated diagrammatically in FIG. 1.

Figure 4:
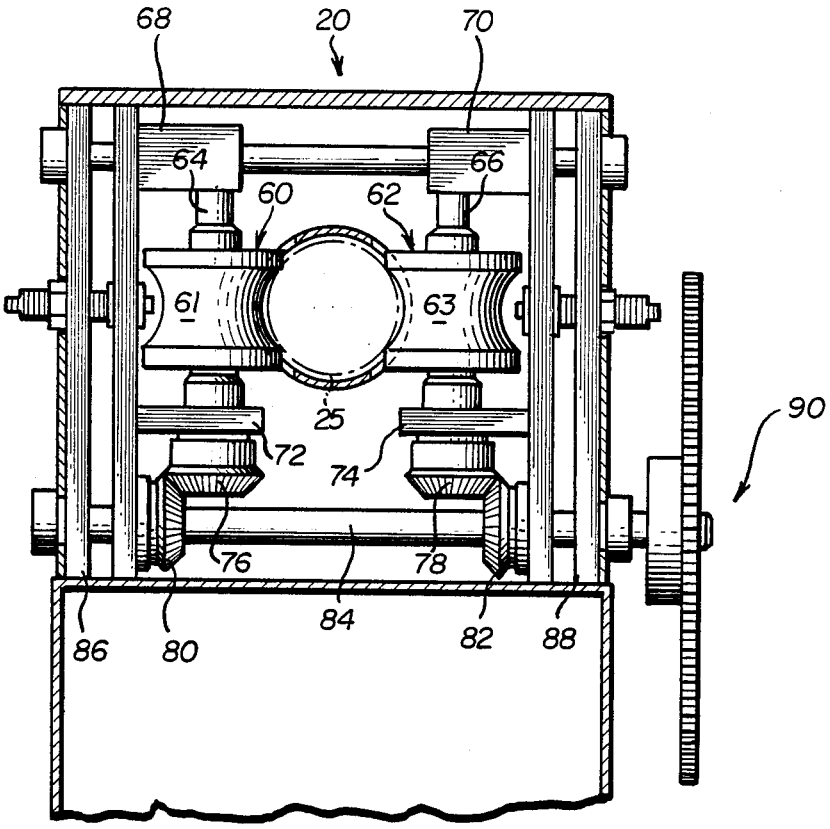
FIG. 4 is a partial sectional view taken generally in the plane of the line 4—4 of FIG. 1.

Reference is next directed to FIG. 4, wherein details of the pushing means or advancing and repositioning means 20 are illustrated. Advantageously, the pushing means includes a pair of rotatably mounted roller members 60, 62 which are disposed for contacting generally radially spaced peripheral edge portions of the can ends, which are indicated in phantom line at reference numeral 25. Departing from our above-referenced prior patent, in order to maintain the desired controlled degree of resistance of the can ends by the resisting means 30, these roller means 60, 62 are additionally coupled with means for rotatably driving at least one of the rollers in a direction for advancing the can ends along the trough-like member 22. In the illustrated embodiment both rollers 60 and 62 are so driven.

Briefly, the drive means includes respective generally vertically oriented shaft members 64, 66 which mount the respective rollers and which shaft members are rotatably journalled intermediate respective upper and lower support or frame members 68, 70 and 72, 74. Preferably, an end portion of each shaft extends through its lower support or frame member 72, 74 and has coupled thereto a bevel gear member 76, 78. Complementary bevel gears 80, 82 are provided in contact with bevel gears 76 and 78, respectively, and are mounted to a further rotatably journalled, horizontally extending or traverse shaft member 84. This latter shaft member 84 is rotatably journalled to opposite side wall or frame members 86, 88 and extends outwardly of the latter frame or wall member 88 to be driven by suitable rotatable drive means illustrated somewhat diagrammatically at reference numeral 90. Suitable motors, gearing and the like may be provided for this purpose, whereby the drive means 90 is somewhat diagrammatically indicated as an enlarged gear in FIG. 4.

In accordance with a further feature of the invention, the rollers 60, 62 have generally concave surfaces 61, 63 which are formed generally for complementary engagement with substantial portions of the can end peripheral edge parts. In this regard, it will be seen that each of these concave surfaces 61, 63 contacts the can end 25 along a substantial arcuate or angular extent of its peripheral edge. In the illustrated embodiment, the rollers are symmetrically disposed relative to the edge of can ends 25 and generally opposite transverse or horizontally disposed diametric opposed portions thereof so as to generally provide both vertical and horizontal support to the can ends as they are advanced thereby. Advantageously, the rollers are preferably formed from a somewhat resilient or elastomeric, rubber-like material to enhance the desired engagement with an advancement of the can ends 25 thereby.

Figure 2:
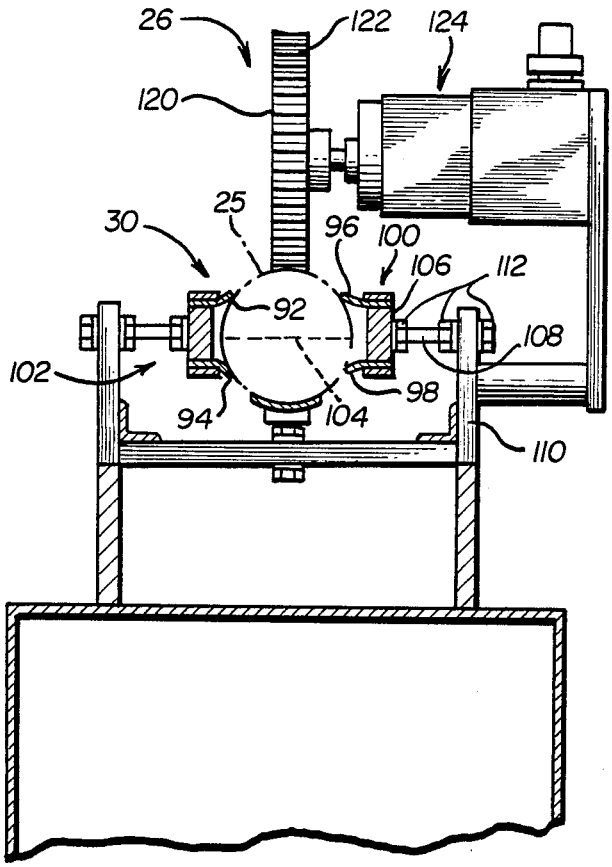
FIG. 2 is a partial sectional view taken generally in the plane of the line 2—2 of FIG. 1.
Figure 5:
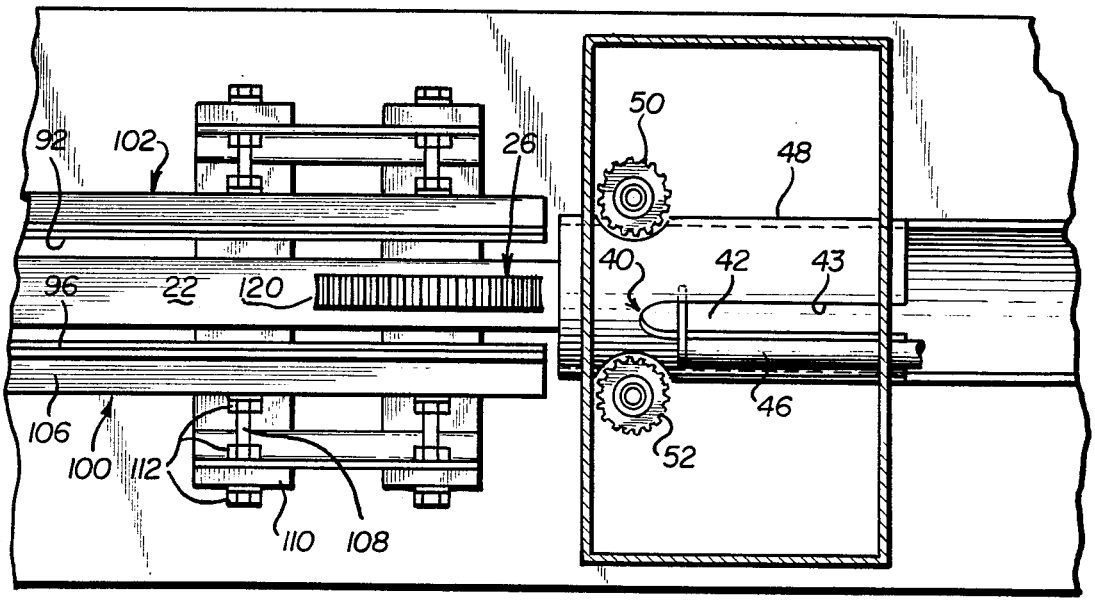
FIG. 5 is a partial sectional view taken generally in the plane of the line 5—5 of FIG. 1.

Referring next to FIGS. 2 and 5, resisting means 30 will be seen to comprise a plurality of elongate strips of resilient material extending axially along the trough-like member 22. In the illustrated embodiment these elongate resilient strips are four in number, designated by reference numerals 92, 94 and 96, 98. It will be appreciated that these strips of resilient material are disposed for generally extending into the path of the can ends 25 when the strips are in an undeformed condition. However, as illustrated in FIG. 2, these strips resiliently bend outwardly somewhat relative to the ends 25 for resilient engagement with the peripheral edges of the can ends 25 at a plurality of points about the respective peripheries thereof. Hence, these strips 92, 94, etc. tend to generally cooperate with the pushing force applied by rollers 60 and 62 thereby to maintain the can ends in the desired upright and stacked or nested condition, facilitating the passage of the can ends in an upright, nested condition through the trough-like member 22 to be counted by the counter means 26.

Suitable mounting means 100, 102 are provided for mounting the respective strips 92, 94, etc. and for locating these strips disposed for engagement with the peripheral can end edges generally at two pairs of diametrically opposed points thereupon. That is, as best viewed in FIG. 2, it will be noted for example that strips 92 and 98 engage the peripheral edge of can ends 25 at diametrically opposed points thereon, as do respective strips 94 and 96. Preferably, the mounting means 100 and 102 mount or locate the strips so as to generally define these two pairs of diametrically opposed points at respective points located substantially at equal angular offsets from a substantially horizontal or transverse diameter of the can ends, that is, transverse to the axis or direction of travel of cans along the trough-like member 22, when the can ends are in the desired upright condition. This transverse diameter is indicated in phantom line at reference numeral 104.

In the illustrated embodiment, each of the mounting means 100, 102 includes a generally rectilinear, elongate mounting block 106 which receives and engages the respective strips, such as strips 96, 98 at spaced vertical positions thereon as indicated in FIG. 2. This block 106 is mounted to one or more spaced, support members or struts 108 which are spaced along the length of trough 22, and are in turn mounted to one or more external frame-like support members 110. The mounting of struts 108 to frame or support members 110 may be by adjustable means or members 112 which may be bolts coupled to complementary threaded portions of shaft-like strut 108, so as to permit fine adjustment of the position thereof and hence of the position of the strips 92, 94, 96, 98, relative to the peripheries of the can ends 25, to achieve and maintain the desired degree of resistance, as described above.

As best viewed in FIGS. 2 and 5, the counting means comprises a toothed wheel member 120 which is rotatably mounted and disposed generally vertically above the trough-like member 22. This wheel 120 preferably is positioned so as to extend into the path of travel of the can ends 25 for engagement of respective individual teeth thereof with respective individual can ends as each passes thereby. This engagement is such as to rotate the wheel by successive incremental amounts corresponding to individual can ends passing thereby. That is, the teeth 122 are preferably configured and spaced for accommodating but a single can end intermediate each adjacent pair of teeth for this purpose. Accordingly, an incremental amount of rotation of wheel 120 corresponding generally to the angular distance between any adjacent pair of teeth 122 thereupon will correspond to the passage of an individual can end. Hence, rotation of wheel 120 may be monitored by suitable means 124 indicated diagrammatically in FIG. 2 to maintain an accurate count of the can ends passing through the apparatus 10.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A can end counting system comprising: an elongate trough-like member for receiving and guiding a plurality of can ends in a substantially upright, nested condition, said trough-like member defining generally a longitudinal axis and having an entrance end and an exit end relative to the direction of travel of said can ends therethrough; pusher means adjacent said entrance end of said trough-like member for pushing said can ends therealong; resisting means located along said trough-like member for engaging said can ends in a predetermined fashion for maintaining a controlled degree of resistance of said can ends relative to said pushing means so as to maintain said can ends in said upright and nested condition as they travel through said trough-like member; and counting means located adjacent said exit end of said trough-like member for producing a discrete detectable signal in response to the passage of each can end thereby, such that the discrete signals may be detected and counted to maintain a count of the can ends passing through the counting system; wherein said pushing means comprises a pair of rotatably mounted roller members disposed for contacting the can ends at radially spaced peripheral edge parts thereof, and means for rotatably driving at least one of said rollers in a direction for advancing said can ends along said trough-like member; and wherein said rollers have generally concave surfaces formed for complementary engagement with substantial portions of said can end peripheral edge parts.

2. A system according to claim 1 wherein said rollers are formed from a resilient, rubber-like material.

3. A system according to claim 1 wherein said resisting means comprises a plurality of strips of resilient material extending axially along said trough-like member and disposed for resilient engagement with peripheral edge parts of said can ends at a plurality of points about the respective peripheries thereof.

4. A system according to claim 3 wherein said plurality of strips of resilient material are four in number, and mounting means for locating said strips disposed for engagement with said can end peripheral edge parts generally at two pairs of diammetrically opposed points thereupon.

5. A system according to claim 4 wherein said mounting means locate resilient strips so as to define said two pairs of diammetrically opposed points comprise respective points located at substantially equal angular offsets from a substantially horizontal diameter of said can ends which is transverse to said trough-like member axis when the can ends are in the desired upright condition.

6. A system according to claim 1 wherein said counting means comprises a toothed wheel member rotatably mounted and disposed generally vertically above said trough-like member and configured and positioned for engagement of each of the respective teeth thereof with an upper edge portion of an individual can end as it passes thereby, so as to rotate said wheel by successive incremental amounts corresponding to respective individual can ends passing thereby.

7. A can end counting system comprising: an elongate trough-like member for receiving and guiding a plurality of can ends in a substantially upright, nested condition, said trough-like member defining generally a longitudinal axis and having an entrance end and an exit end relative to the direction of travel of said can ends therethrough; pusher means adjacent said entrance end of said trough-like member for pushing said can ends therealong; resisting means located along said trough-like member for engaging said can ends in a predetermined fashion for maintaining a controlled degree of resistance of said can ends relative to said pushing means so as to maintain said can ends in said upright and nested condition as they travel through said trough-like member; and counting means located adjacent said exit end of said trough-like member for producing a discrete detectable signal in response to the passage of each can end thereby, such that the discrete signals may be detected and counted to maintain a count of the can ends passing through the counting system; wherein said resisting means comprises two pairs of strips of resilient material extending axially along said trough-like member and means for locating said two pairs of strips such that they define upon each can end, when said can end is in the desired upright condition within said trough-like member, respective points located at substantially equal angular offsets from a substantially horizontal diameter of said can ends, which horizontal diameter is transverse to said trough-like member axis.

* * * * *